US006481385B1

(12) United States Patent
Gummel et al.

(10) Patent No.: US 6,481,385 B1
(45) Date of Patent: Nov. 19, 2002

(54) FLUIDIZED BED COMBUSTION SYSTEM WITH STEAM GENERATION

(75) Inventors: Peter Gummel, Bad Soden (DE); Werner-Friedrich Staab, Rosbach (DE)

(73) Assignee: Metallgesellschaft Aktiengesellschaft, Frankfurt/Main (DE)

( * ) Notice: Subject to any disclaimer, the term of this patent is extended or adjusted under 35 U.S.C. 154(b) by 0 days.

(21) Appl. No.: 09/701,124

(22) PCT Filed: May 17, 1999

(86) PCT No.: PCT/EP99/03376

§ 371 (c)(1),
(2), (4) Date: Nov. 17, 2000

(87) PCT Pub. No.: WO99/60305

PCT Pub. Date: Nov. 25, 1999

(30) Foreign Application Priority Data

May 18, 1998 (DE) ..... 198 22 304
Aug. 1, 1998 (DE) ..... 198 34 881

(51) Int. Cl.[7] ..... F22B 1/00
(52) U.S. Cl. ..... 122/4 D; 110/245

(58) Field of Search ..... 122/4 D; 110/245

(56) References Cited

U.S. PATENT DOCUMENTS 4,240,377 A * 12/1980 Johnson ..... 122/4 D
4,665,864 A 5/1987 Seshamani
4,815,418 A 3/1989 Maeda
5,911,201 A * 6/1999 Eickenberg ..... 122/4 D

FOREIGN PATENT DOCUMENTS

DE 28 04 073 A 8/1978
DE 31 07 356 A1 9/1982

* cited by examiner

*Primary Examiner*—Jiping Lu
(74) *Attorney, Agent, or Firm*—Herbert Dubno

(57) ABSTRACT

A solid fuel fluidized-bed steam generator in which a pair of combustion chambers straddle a heat-exchange chamber of rectangular configuration in a row and have one or more gas/solids separators connected to the combustion chambers at the tops thereof and lines which deliver gas from the separators to the heat-exchange chamber. The heat-exchange chamber has a plurality of heat-exchange elements for indirect heat exchange between hot gas and a cooling fluid, for example water, which is converted to steam.

5 Claims, 2 Drawing Sheets

FLUIDIZED BED COMBUSTION SYSTEM WITH STEAM GENERATION

CROSS REFERENCE TO RELATED APPLICATIONS

This is a national stage of PCT/EP99/03376 filed May 17, 1998 and based upon German national applications 198 22 304.8 of May 18, 1998 and 198 34 881.9 of Aug. 1, 1998 under the International Convention

FIELD OF THE INVENTION

This invention relates to a fluidized-bed firing system with generation of steam for the combustion of solid fuels and for generating steam.

BACKGROUND OF THE INVENTION

Such systems, which are advantageous for smaller power outputs, are known for instance from EP-B-0365723, EP-A-0416238 as well as DE-A-3107356 and DE-A-4135582. In the known plants, only a single fluidized-bed combustion chamber is associated with a heat-exchange chamber. For large plants, which generate a large amount of steam that is used in power plants with more than 250 MW (electrical) capacity, the known systems are not advantageous.

OBJECT OF THE INVENTION

It is the object of the invention to provide a fluidized-bed firing system in a compact design such that it can be built as a block requiring little space.

SUMMARY OF THE INVENTION

In accordance with the invention this achieved in a) that in a heat-exchange chamber with an inner (internal) height of at least 10 m, there are disposed heat-exchange elements through which flows a cooling fluid, and the heat-exchange chamber has four vertical outer walls which enclose a space approximately rectangular in horizontal cross-section.

b) that outward of a first outer wall of the heat-exchange chamber a first fluidized-bed combustion chamber is disposed, and outwardly of a second outer wall of the heat-exchange chamber opposite the first outer wall a second fluidized-bed combustion chamber is disposed, where the inner height of the fluidized-bed combustion chamber is 10 to 60 m and preferably at least 20 m, and each fluidized-bed combustion chamber has lines for supplying fuel and combustion air, and c) that with the upper portion of each fluidized-bed combustion chamber at least one separator is connected for separating solids from a gas stream, which separator has at least one gas-carrying discharge line connected with the heat-exchange chamber.

In one embodiment of the invention, each fluidized-bed combustion chamber is associated with at least one fluidized-bed cooler which is disposed below a separator and is connected therewith by a solids-carrying line. Each fluidized-bed cooler is connected with the associated fluidized-bed combustion chamber through at least one line carrying solids and/or gas.

The plant in accordance with the invention can be designed and build as a compact block. At the same time it is possible easily to arrange one or more blocks one beside the other in a space-saving way with or without physical separation. Inside each block, the central arrangement of the heat-exchange chamber provides for an inexpensive construction due to short lines for the combustion air delivered to the fluidized-bed combustion chambers, which combustion air is preheated in the heat-exchange chamber or in other suitable means. Each fluidized-bed combustion chamber may be connected with the associated fluidized-bed cooler to form a static unit, where the fluidized-bed cooler can be designed as a mounted construction or can be suspended from the fluidized-bed combustion chamber. A particularly space-saving design of the firing system is obtained in that the distance between the first fluidized-bed combustion chamber and the first outer wall as well as the distance between the second fluidized-bed combustion chamber and the second outer wall of the heat exchanger chamber is 0 to 2 m.

The firing system in accordance with the invention is designed for big plants. In general, the cross-sectional area of each of the two fluidized-bed combustion chambers, measured in a horizontal plane and at half height of the interior of the chamber, will be 50 to 300 $m^2$ and preferably at least 70 $m^2$. Usually, the interiors of the first and second fluidized bed combustion chambers will be approximately rectangular in horizontal cross-section. For very big plants, two or more heat-exchange chambers and at least three fluidized-bed combustion chambers can be arranged side-by-side alternatingly.

BRIEF DESCRIPTION OF THE DRAWING

Further embodiments will be explained with reference to the drawing, wherein.

SPECIFIC DESCRIPTION

Figure 1:
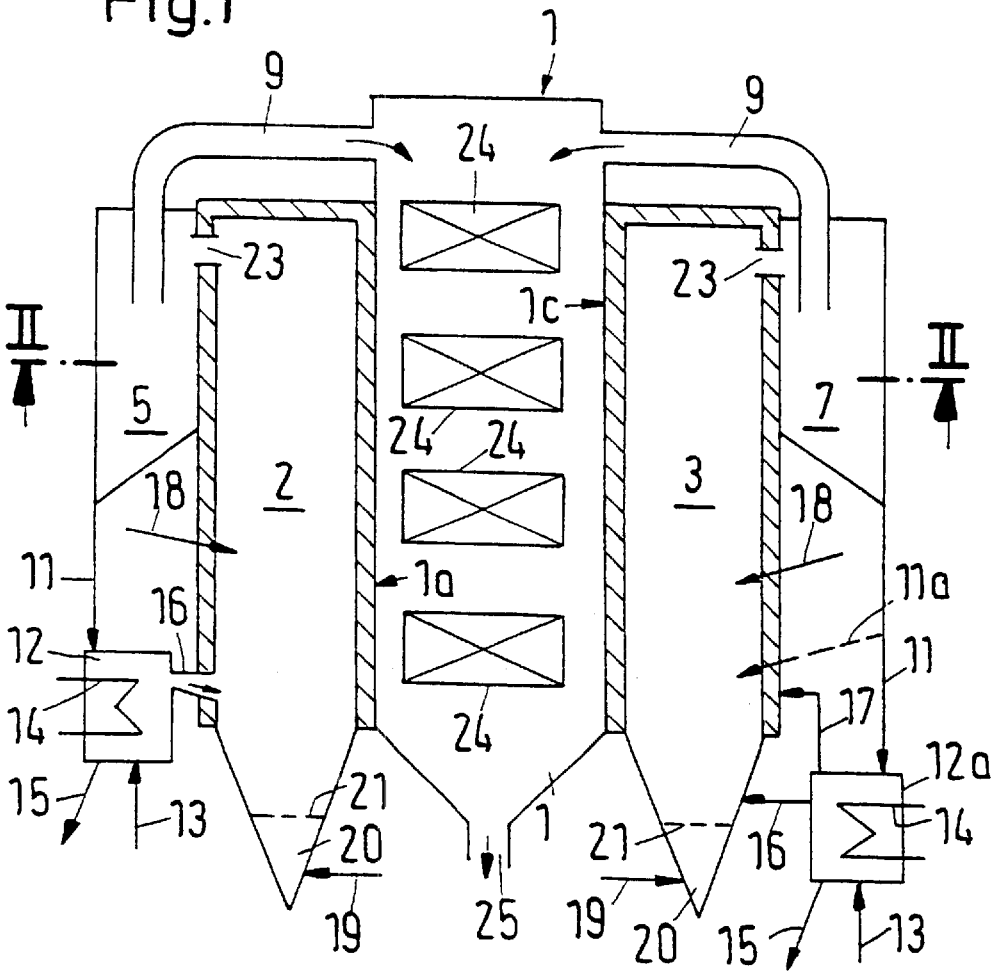
FIG. 1 is a schematic representation of a first variant of the firing system in a longitudinal section along line I—I of FIG. 2.
Figure 2:
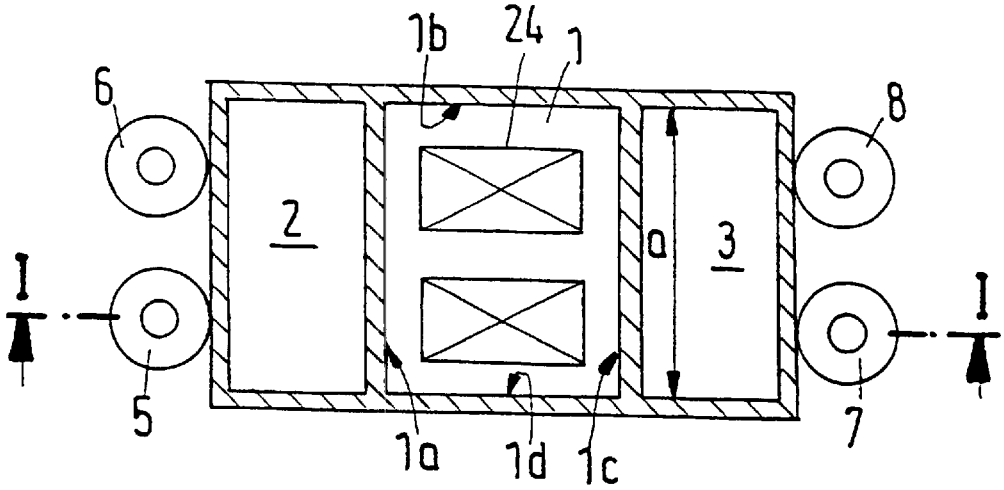
FIG. 2 is a cross-section along line II—II of FIG. 1.

The plant in accordance with FIGS. 1 and 2 centrally comprises a heat-exchange chamber 1 with a rectangular cross-section of FIG. 2. The four vertical outer walls of the heat-exchange chamber 1 are designated with the reference numerals 1*a*, 1*b*, 1*c* and 1*d*. Adjoining the first outer wall 1*a* a first fluidized-bed combustion chamber 2 is provided. At the opposite wall 1*c* a second fluidized-bed combustion chamber 3 is provided. To the left fluidized-bed combustion chamber 2 two separators 5 and 6 are connected, and two separators 7 and 8 correspondingly belong to the right fluidized-bed combustion chamber 3. Each separator has a gas-carrying discharge line 9, which opens into the upper portion of the heat-exchanger chamber 1, cf. FIG. 1. Any number of separators maybe used. As separators, there may for instance be used cyclones known per se or baffle plate separators.

The solids separated in the separators 5 to 8 are delivered through line 11 to a fluidized-bed cooler 12 or 12*a* know per se. Details of the fluidized-bed cooler can be taken for instance from EP-B-0365723 and DE-A-4135582. If desired, solids separated in the separator can directly be introduced into the nearest fluidized-bed combustion chamber via a bypass line 11*a*. This is repressented in the drawing for a better clarity only for the chamber 3 in FIG. 1. If fluidized-bed coolers 12 and 12*a* are completely omitted, the solids coming from the separators are introduced into the fluidized bed combustion chambers via such bypass lines.

Each fluidized-bed cooler is equipped with at least one line 13 for supplying fluidizing gas, e.g. air. It also has cooling elements 14 and an outlet 15 for cooled solids. Through the passage 16, part of the cooled solids are introduced into the fluidized-bed combustion chamber 2 together with gas. One variant is illustrated together for the heat exchanger 12*a* and the fluidized-bed combustion chamber 3 in FIG. 1, where line 16 supplies cooled solids, and line 17 supplies heated fluidizing gas to the chamber 3. Solid, granular fuels are supplied to the chambers 2 and 3 through the lines 18, and oxygen-containing fluidizing gas, e.g. air, is supplied via line 19. The fluidizing gas first enters a distribution chamber 20 and then flows upwards in the chamber 2 through a grid 21. Further points for supplying gases and solids can easily be provided.

Suitable fuels include in particular anthracite coal, hard coal, lignite, wood, or oil shale. In addition to solid fuel there may also be used pasty, liquid or gaseous fuels, e.g. refinery residues or various wastes. The combustion temperatures in the fluidized-bed combustion chambers 2 and 3 lie in the range from 700 to 950°.

A hot gas-solids suspension leaves the fluidized-bed combustion chamber 2 or 3 at the upper portion thereof through an opening 23 and flows into the associated separator, in which the solids are largely separated. The hot gases leave the separator through line 9 and are cooled in the heat-exchange chamber 1. The chamber 1 is equipped with numerous heat-exchange elements 24 for an indirect cooling of the hot gas, which elements are represented in the drawing only schematically. The elements 24 on the one hand serve to generate steam from boiler feed water, where high-pressure steam with a pressure in the range from 70 to 350 bar and medium-pressure steam with a pressure of 20 to 80 bar can be generated at the same time or alternatively. One or more of the elements 24 can also be used for preheating the air which is then introduced as combustion air into one of the fluidized bed combustion chambers 2 and 3.

The plant is designed for large throughputs, so that the individual parts of the plant have correspondingly large dimensions. The cross-sectional area of the interior of the heat-exchange chamber 1, measured in a horizontal plane at half height of the chamber 1, lies in the range from 150 to 500 $m^2$. For each of the fluidized-bed combustion chambers 2 or 3 the inner horizontal cross-sectional area, measured at half height above the grid 21, is 50 to 300 $m^2$. The height of a chamber 2 and 3, measured above the grid 21, lies in the range from 20 to 60 m. The horizontal width (a) of the common walls 1*a* and 1*c*, cf. FIG. 2 is 10 to 40 m.

To the firing system, there may be connected a power plant with an electric power capacity of 200 MW or more. To optimally utilize the sensible heat in the firing system, all hot walls may be designed as membrane tubular walls, through which flows a cooling fluid. Cooled gas, which leaves the heat-exchange chamber 1 through the outlet 25, is supplied to a gas cleaning system not represented here.

Figure 3:
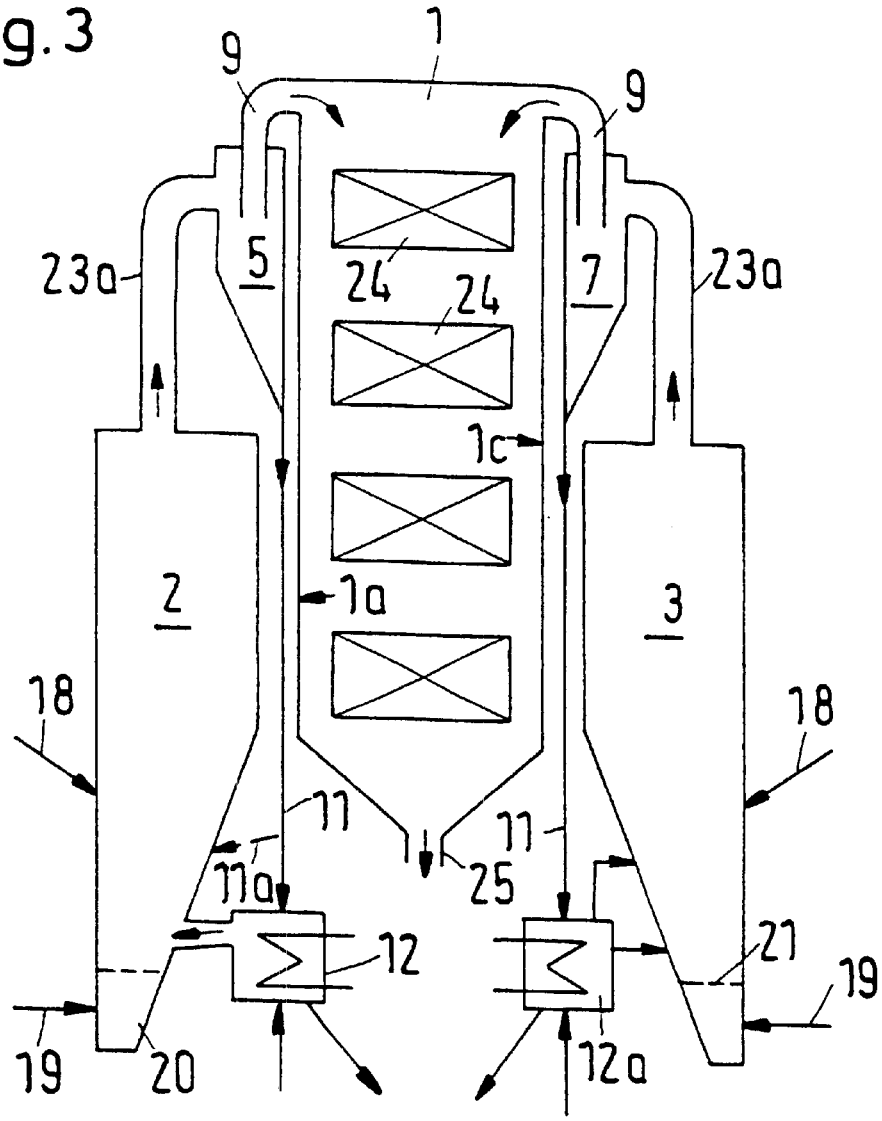
FIG. 3 is a second variant of the firing system in a representation analogous to FIG. 1.

As already explained in conjunction with FIGS. 1 and 2, the plant in accordance with FIG. 3 comprises a central heat-exchange chamber 1, two fluidized-bed combustion chambers 2 and 3, and separators 5 and 7. The lines 23a connect the fluidized-bed combustion chambers 2 and 3 with the separators 5 and 7. Identical reference numerals as in FIGS. 1 and 2 have the meanings as stated in the description thereof. The fluidized-bed combustion chambers in accordance with FIG. 3 have a downwardly wedge-shaped design.

In the plant in accordance with FIG. 3, there is a distance of not more than 2 m between the outer wall 1*a* of the heat-exchange chamber 1 and the fluidized-bed combustion chamber 2, over which distance line 11 passes through to the fluidized-bed cooler 12. The same distance also exists between the wall 1*c* and the fluidized-bed combustion chamber 3. Since the separators 5 and 7 are disposed above the chambers 2 and 3, the block is high and requires little ground area.

Figure 4:
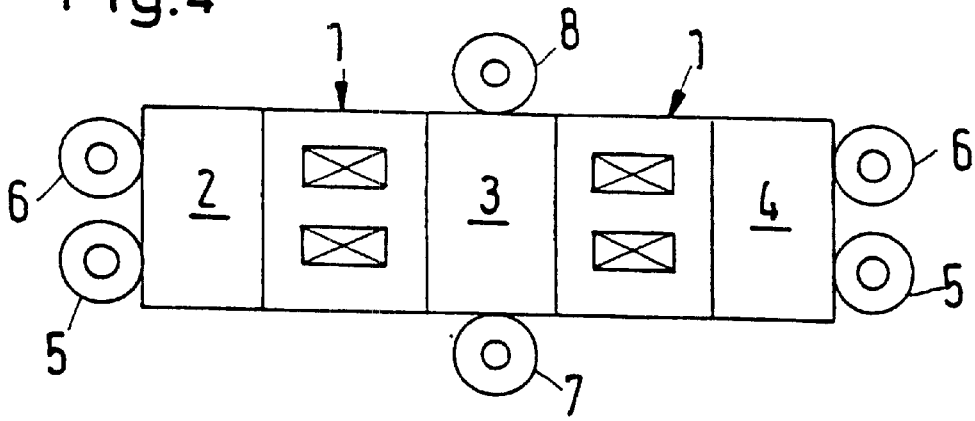
FIG. 4 is a bag plant with two heat-exchange chambers in a representation analogous to FIG. 2.

In the big plant schematically represented in FIG. 4 in a horizontal section, two heat-exchange chambers 1 and three fluidized-bed combustion chambers 2, 3 and 4 are put side-by-side alternatingly. The separators are provided with the reference numerals 5 to 8. In contrast to the row arrangement shown in FIG. 4, the chambers may be arranged together with further heat-exchange chambers and/or fluidized-bed combustion chambers to form altogether a cross, an L or T in a horizontal section.

What is claimed is:

1. A solid fuel fluidized-bed steam-generating firing system in a block form, comprising:

a vertically elongated heat-exchange chamber of substantially rectangular horizontal cross section delimited by four outer walls and having an interior height of at least 10 m;

a plurality of heat-exchange elements in said chamber for indirect heat exchange between hot gas in said chamber and cooling fluid in said elements, at least one of said elements being traversed by water for conversion to steam;

a first vertically elongated fluidized-bed combustion chamber disposed along one of said outer walls and a second vertically elongated fluidized-bed combustion chamber disposed along another of said outer walls opposite said one of said outer walls for producing hot gas by combustion of solid fuel therein, said fluidized-bed combustion chambers having interior heights of 10 m to 60 m and means for supplying solid fuel and fluidizing gas to said fluidized-bed combustion chambers;

at least one gas/solids separator connected to an upper portion of each of said fluidized-bed combustion chambers for separating solids from hot gas produced in the respective fluidized-bed combustion chamber, said gas/solids separators extending along outer side walls of the respective fluidized bed combustion chambers on opposite sides thereof from said heat-exchange chamber;

respective gas-carrying discharge lines connecting upper portions of said gas/solids separators to an upper portion of said heat-exchange chamber for delivery of hot gas thereto, whereby hot gas is cooled in said heat-exchange chamber in indirect heat exchange with said elements and a cooled gas is discharged at a lower portion of said heat-exchange chamber; and at least one fluidized-bed cooler for each of said fluidized-bed combustion chambers, located directly below a respective gas/solids separator thereof, connected with the respective gas/solids separator by a solids-carrying line to cool solids received from the respective gas/solids separator, and connected with the respective fluidized-bed combustion chamber with a respective line carrying solids or gas thereto, a distance between each of said fluidized-bed combustion chambers and the respective outer wall is 0 to 2 m.

2. The solid fuel fluidized-bed steam-generating firing system in block form defined in claim 1 wherein said fluidized-bed combustion chambers have half-height cross sections in horizontal planes of 50 to 300 $m^2$.

3. The solid fuel fluidized-bed steam-generating firing system in block form defined in claim 1 wherein horizontal cross sections of said fluidized-bed combustion chambers are approximately rectangular.

4. The solid fuel fluidized-bed steam-generating firing system in a block form defined in claim 1, wherein said chambers form a row and have a width transverse to said row of 10 to 40 m.

5. The solid fuel fluidized-bled steam-generating firing system in a block form defined in claim 1 wherein at least two of said heat exchange chambers and at least three of said fluidized-bed combustion chambers are provided in a row with said fluidized-bed combustion chambers alternating with said heat-exchange chambers along said row.

* * * * *